US007241235B2

(12) United States Patent
Caruso

(10) Patent No.: US 7,241,235 B2
(45) Date of Patent: Jul. 10, 2007

(54) TAMPER RESISTANT FASTENER FOR SPORTS NETTING

(75) Inventor: Anthony Caruso, Center Valley, PA (US)

(73) Assignee: Kwik Goal Ltd, Quakertown, PA (US)

( * ) Notice: Subject to any disclaimer, the term of this patent is extended or adjusted under 35 U.S.C. 154(b) by 0 days.

(21) Appl. No.: 11/261,111

(22) Filed: Oct. 28, 2005

(65) Prior Publication Data

US 2006/0131812 A1 Jun. 22, 2006

Related U.S. Application Data

(60) Provisional application No. 60/636,573, filed on Dec. 16, 2004.

(51) Int. Cl.
*A63B 63/00* (2006.01)
*F16B 19/00* (2006.01)

(52) U.S. Cl. ..... 473/478; 473/454; 473/497; 273/400; 411/510

(58) Field of Classification Search ..... 273/398–402; 473/454–456, 476, 478, 470, 471, 491–495; 411/508–510; 248/71, 73, 228.7; 24/339, 24/563, 581.1, 580.11, 115 A, 370; 256/48, 256/56

See application file for complete search history.

(56) References Cited

U.S. PATENT DOCUMENTS

| | | | | |
|---|---|---|---|---|
| 3,378,879 | A | 4/1968 | Stall | |
| 3,434,524 | A | 3/1969 | Fein | |
| 4,083,395 | A | 4/1978 | Romano | 160/84 R |
| 4,169,598 | A | 10/1979 | Taylor | 273/127 B |
| 4,241,916 | A | 12/1980 | Palm | 273/1.5 R |
| 4,368,891 | A | 1/1983 | Neisius | 273/400 |
| 4,420,138 | A | 12/1983 | Sobel | 248/496 |
| 4,796,684 | A | 1/1989 | Haimovitz | 160/330 |
| 4,804,166 | A | 2/1989 | Makus | 256/48 |
| 5,116,056 | A | 5/1992 | Schmutte | 273/181 F |
| 5,476,266 | A | 12/1995 | Caruso | 273/411 |
| 5,564,711 | A * | 10/1996 | Scheie | 273/400 |
| 5,599,024 | A | 2/1997 | Acuff et al. | 473/478 |
| 5,902,194 | A * | 5/1999 | Wade | 473/446 |
| 5,938,546 | A | 8/1999 | Caruso | 473/434 |
| 5,951,415 | A | 9/1999 | Gates et al. | 473/478 |
| 6,142,892 | A | 11/2000 | Dennis | 473/494 |
| 6,209,878 | B1 | 4/2001 | Munro | 273/400 |
| 6,261,196 | B1 | 7/2001 | Caruso | 473/476 |
| 6,286,286 | B1 | 9/2001 | Simonar | 52/716.1 |
| 6,383,096 | B1 | 5/2002 | Green | 473/415 |
| 6,561,931 | B1 * | 5/2003 | Reeves | 473/471 |
| 6,578,745 | B1 | 6/2003 | Taylor et al. | 224/197 |
| 6,793,595 | B1 | 9/2004 | Monnet | 473/478 |
| 6,846,253 | B1 | 1/2005 | Szwalek | 473/446 |
| 2003/0181264 | A1 * | 9/2003 | Yoon | 473/421 |
| 2003/0224884 | A1 * | 12/2003 | Oister et al. | 473/478 |

* cited by examiner

*Primary Examiner*—Mark S. Graham
(74) *Attorney, Agent, or Firm*—Howson & Howson LLP

(57) ABSTRACT

A vandal resistant sports goal net clip, or fastener, for attaching nets to the frames of sports goals. The fasteners are difficult to remove by hand and require the use of a separate tool to attach and remove the net from the frame. Sports goal assemblies and methods of securing nets to goal frames are also disclosed.

12 Claims, 5 Drawing Sheets

TAMPER RESISTANT FASTENER FOR SPORTS NETTING

CROSS-REFERENCE TO RELATED APPLICATIONS

This application claims the benefit under 35 USC §119(e) of U.S. Provisional Application No. 60/636,573, filed Dec. 16, 2004.

BACKGROUND OF THE INVENTION

The present invention relates to securing nets to sport goal frames, and more particularly to a fastener, a goal assembly, and a method for securing sports nets to goal frames.

A conventional goal, such as a soccer goal, includes a pair of goal posts connected by a crossbar which together define a goal mouth. Such goals typically include other framework such as back bottom bars, base bars, backstays, back net posts and the like used to hold the net in an upright position a spaced distance behind the goal mouth.

Goal nets are typically made of braided or twisted polyethylene, polyester, or HTPP rope or the like that forms a mesh and may include a perimeter rope to hold the edges of the net together. The goal net is typically secured to the perimeter of the goal frame with flexible ties or with S-shaped clips having one end engaging the perimeter of the net and the other end attached to the frame.

A net fastening system is disclosed in U.S. Pat. No. 5,476,266 issued to Caruso, which is owned by Kwik Goal Ltd., the assignee of the present application. The system includes a goal frame having a channel extending along the perimeter of the frame. The perimeter rope of the net is secured within the channel of the goal posts using U-shaped clips. The Kwik Lock® Net Channel System has proven to be commercially successful due to the ease with which nets can be secured and removed from goal frames without the use of separate tools.

Examples of other sports goals and nets are disclosed by U.S. Pat. Nos. 6,142,892 issued to Dennis; U.S. Pat. No. 6,793,595 B1 issued to Monnet; U.S. Pat. No. 6,561,931 B1 issued to Reeves; U.S. Pat. No. 6,383,096 B1 issued to Green; U.S. Pat. No. 4,169,598 issued to Taylor; U.S. Pat. No. 4,368,891 issued to Neisius; U.S. Pat. No. 6,846,253 B1 issued to Szwalek; U.S. Pat. No. 6,209,878 B1 issued to Munro; U.S. Pat. No. 5,951,415 issued to Gates et al.; U.S. Pat. No. 5,599,024 issued to Acuff et al.; U.S. Pat. No. 4,241,916 issue to Palm; and U.S. Pat. No. 5,116,056 issued to Schmutte. Examples of clips in general are disclosed by U.S. Pat. No. 4,804,166 issued to Makus; U.S. Pat. No. 3,378,879 issued to Stall; U.S. Pat. No. 3,434,524 issued to Fein; U.S. Pat. No. 4,083,395 issued to Romano; U.S. Pat. No. 4,796,684 issued to Haimovitz; U.S. Pat. No. 6,286,286 B1 issued to Simonar; U.S. Pat. No. 6,578,745 B1 issued to Taylor et al.; and U.S. Pat. No. 4,420,138 issued to Sobel.

While the clips, goals, and net fastening devices disclosed in the above referenced patents may function in an acceptable manner, there is a need for a clip, goal assembly, and method that enable a sports net to be readily secured to a goal frame in a minimum of time and with a minimum of effort and that provides pilfer and tamper resistance. Preferably, the clip should resist removal by hand and should require the use of a removal tool.

BRIEF SUMMARY OF THE INVENTION

According to one aspect of the present invention, a sports goal assembly is provided. The assembly includes a goal net, a goal frame defining a goal mouth, and one or more tamper resistant fasteners used to secure the goal net to the goal frame. Removal of the goal net from the goal frame requires use of a separate tool thereby deterring unwanted removal of the goal net and fasteners from the goal frame.

According to a preferred assembly, the goal net has a peripheral edge, or rope, and the goal frame has an elongate channel in which the peripheral edge of the goal net can be secured. The channel is defined by a pair of spaced-apart longitudinally-extending sidewalls and an elongate opening defined by a pair of inturned flanges. The tamper resistant fastener has a head section and a depending body section. The body section is insertable into the channel and is positionable into a locking position within the channel. When the fastener is rotated into the locking position, an audible snapping sound is produced, and the fastener frictionally engages at least one of the inturned flanges and sidewalls of the channel to capture the peripheral edge of the net within the channel. The head section of the fastener has a substantially purchase-free, or non-manually grippable, upper surface that is difficult to grasp and turn by hand when the fastener is frictionally engaged with the channel. The head section has a tool engaging surface mechanically engagable by a separate tool for use in rotating the fastener from the locking position to an unlocking position permitting removal of the fastener and net from the channel.

According to another aspect of the present application, a method of assembling a net to a sports goal frame is provided such that removal of the goal net from the goal frame requires the use of a separate tool, thereby deterring unwanted removal of the goal net and fasteners from the goal frame. The method includes inserting a peripheral edge of the goal net and a body section of a fastener into a channel of the goal frame. Thereafter, a head section of the fastener is mechanically engaged by a separate tool and is rotated into a locking position within the channel so that the fastener frictionally engages inturned flanges or opposite sidewalls of the channel to secure the fastener to the channel and capture the peripheral edge of the goal net within the channel. The head section of the fastener has a substantially purchase-free upper surface which is difficult to grasp and turn by hand when the fastener is frictionally engaged with the channel. Removal requires use of the separate tool.

According to a further aspect of the present invention, a fastener or clip is provided for use in securing a sports net to a frame of a sports goal. The fastener has a head section and a narrow body section that depends from the head section. The head section has a substantially purchase-free upper surface and a tool engaging surface mechanically engagable by a separate tool. The body section includes a spaced-apart pair of legs having foot members extending outwardly in opposite directions. Each foot member extends a predetermined spaced distance underneath an underside of the head section. The predetermined spaced distance is of a size enabling the fastener to frictionally engage the inturned flanges of the channel between the foot member and the underside of the head section when the fastener is in a locking position within the channel to secure the net to the frame. The upper surface of the head section is substantially non-manually grippable since it is shaped to be difficult to grasp and turn by hand when the fastener is frictionally engaged with the channel. This deters theft and unwanted removal of the attached net.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE INVENTION

Figure 1:
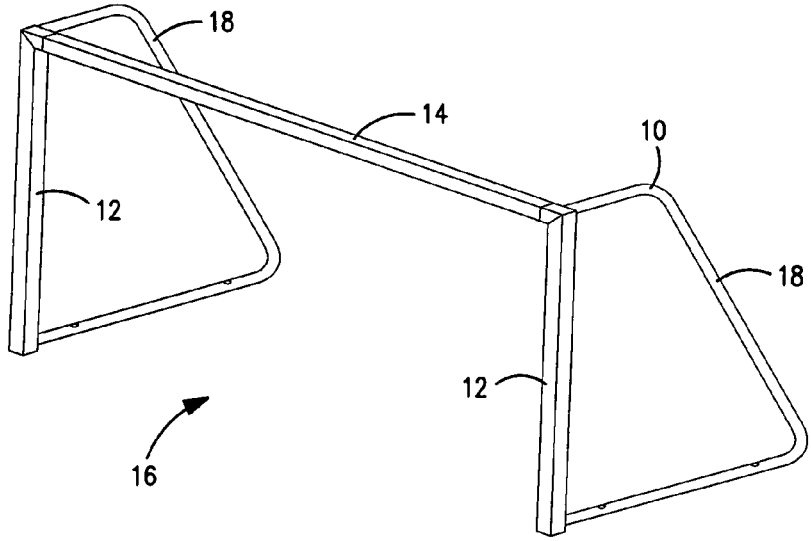
FIG. 1 PRIOR ART
FIG. 1 is a perspective view of a goal frame of a sports goal according to the prior art.

An example of a goal frame 10 for a sports goal is illustrated in FIG. 1. The goal frame 10 includes a pair of upright goal posts 12 and a crossbar 14 defining a goal mouth 16. A pair of backstays 18 extend rearwardly from the posts 12. Although a soccer goal is shown in the illustrated drawings, the present invention can be used in connection with lacrosse goals as well as goals for other sports and goals of various sizes, shapes and designs.

Figure 2:
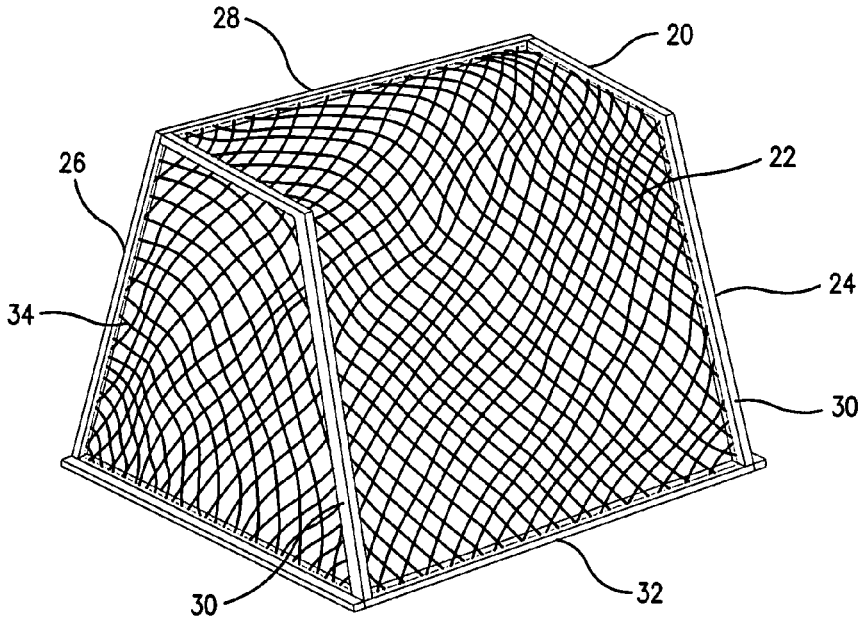
FIG. 2 PRIOR ART
FIG. 2 is a perspective view of a sports goal and net assembly according to the prior art.

An example of an assembled sports goal 20 is illustrated in FIG. 2. The goal 20 includes a goal net 22 secured to a goal frame 24 formed from front upright posts 26, a crossbar 28, backstays 30, and a rear bottom bar 32.

Figure 3:
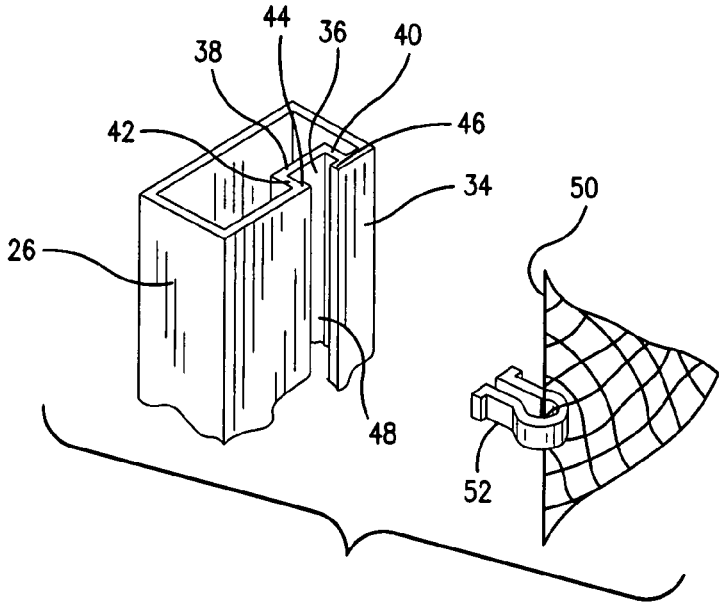
FIG. 3 PRIOR ART
FIGS. 3 and 4 are perspective views of a section of a goal post and net fastening clip according to the prior art.
Figure 4:
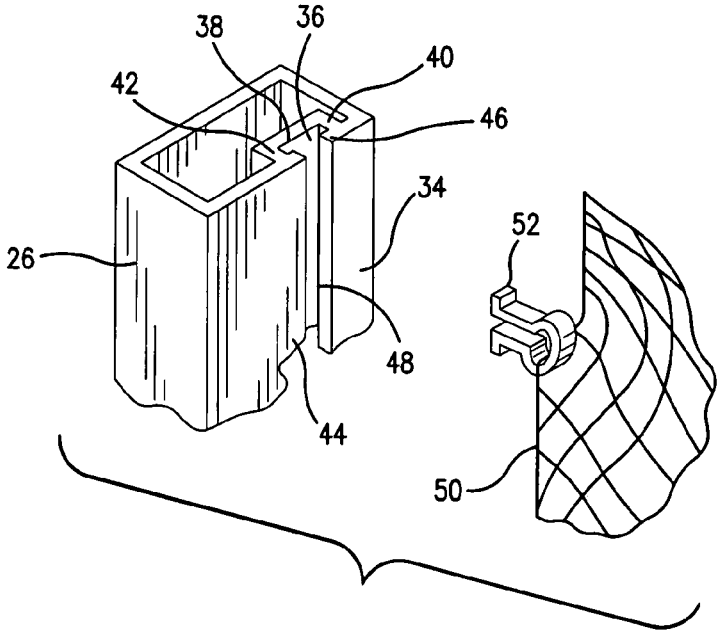
FIG. 4 PRIOR ART
Figure 5:
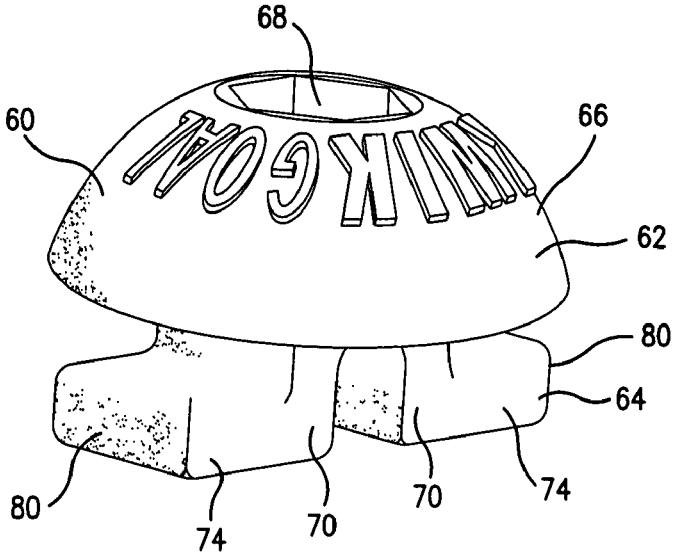
FIG. 5 is a perspective view of a tamper resistant clip, or fastener, according to the present invention.
Figure 6:
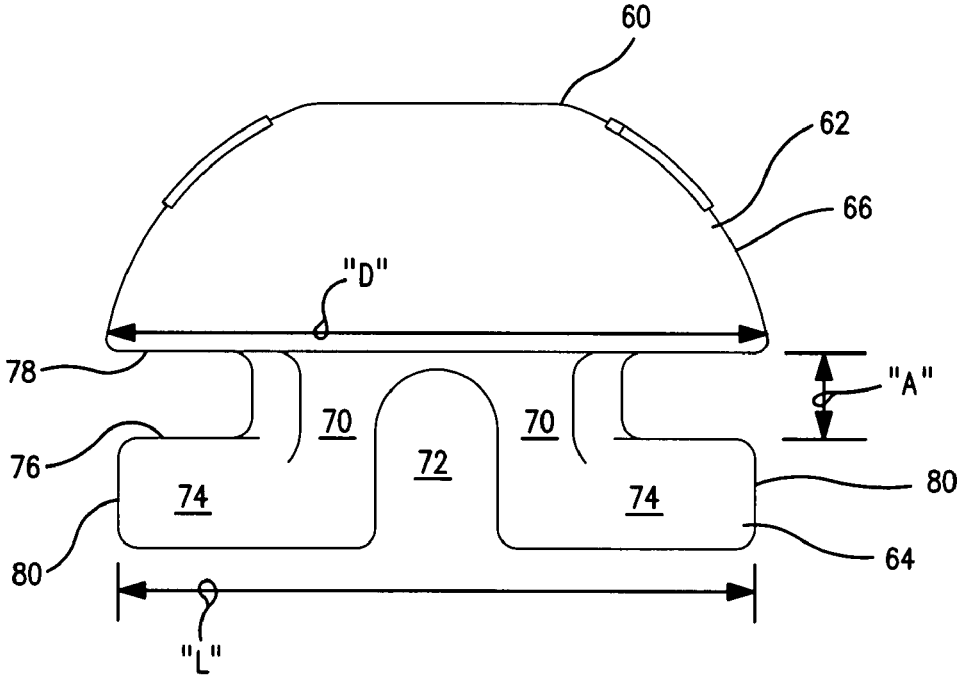
FIG. 6 is a front elevational view of the clip, or fastener, illustrated in FIG. 5.
Figure 7:
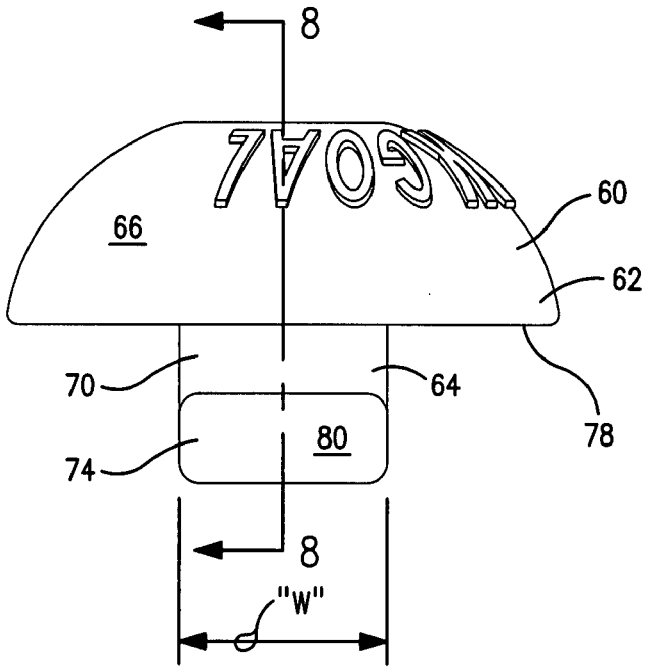
FIG. 7 is a side elevational view of the clip, or fastener, illustrated in FIG. 5.
Figure 8:
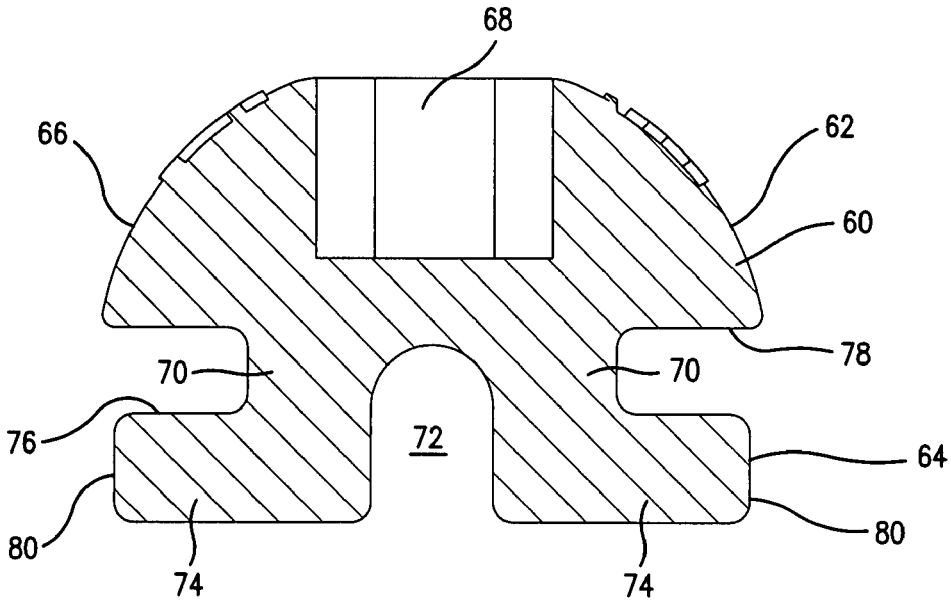
FIG. 8 is a cross-sectional view of the clip, or fastener, illustrated in FIG. 7 along line 8—8.
Figure 9:
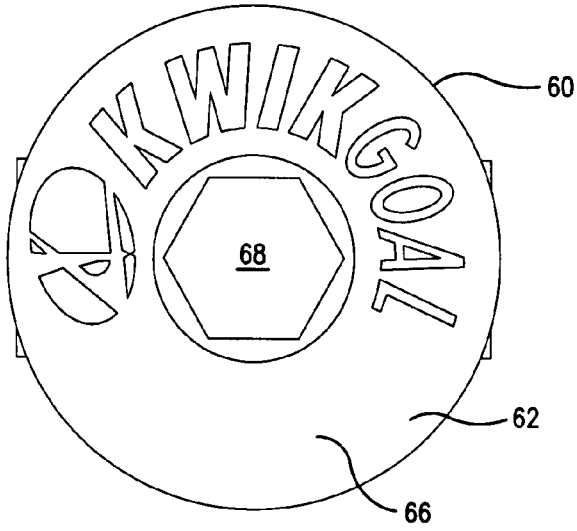
FIG. 9 is a top plan view of the clip, or fastener, illustrated in FIG. 5.

FIGS. 3 and 4 illustrate a prior art system of assembling a net to a sports goal frame. The rearwardly facing side 34 of an upright post 26 of a goal frame includes a longitudinally-extending channel 36. The channel 36 includes a rear wall 38, a pair of longitudinally-extending sidewalls 40 and 42, and a pair of inturned flanges 44 and 46 defining an elongate opening 48 of the channel 36. The side edge 50 of net 22 is connected to the post 26 with a net fastening clip 52. As best illustrated in FIG. 4, the clip 52 can be oriented relative to the opening 50 to permit the clip 52 to be partially inserted into the channel 36. Thereafter, the clip 52 can be rotated 90° so that the clip is captured within the channel 36 thereby securing the net 22 to the post 26. This system is described in U.S. Pat. No. 5,476,266 issued to Caruso, the disclosure of which is incorporated herein by reference.

The above referenced system enables nets to be quickly, easily, and reliably secured to goal frames manually by hand without the use of tools. Removal can be accomplished just as quickly and easily without the use of tools. In some situations, it is desirable to provide prevention with respect to the tampering and/or theft of nets. The above referenced prior art clips do not provide such a feature.

The present invention overcomes the above stated problem with the use of a tamper resistant fastener, or clip, 60 that enables quick, easy and reliable securement of a net to a goal frame while being resistant to unwanted removal. As illustrated in FIGS. 5–9, the fastener 60 according to the present invention has a head section 62 and a body section 64 depending therefrom. The head section 62 is substantially dome-shaped having a smooth upper surface 66 that is formed or shaped to be difficult to grasp and turn by hand when the fastener 60 is secured to a goal frame in a locked position. Accordingly, the upper surface 66 is referred to herein as a substantially non-manually grippable, or purchase-free, surface. A depression 68 is centrally disposed on the head section 62 and provides a tool-engaging surface that can be utilized to unlock the fastener from the goal frame. For example, in the illustrated embodiment the walls of the depression 68 are hex-shaped and are adapted to be engaged by a hex wrench or like tool. Other shaped depressions and the like can be used with corresponding shaped special tools or keys.

The body section 64 of the fastener 60 includes a parallel pair of legs 70 spaced apart by an open slot 72. Legs 70 have outwardly-extending feet 74 extending in opposite directions and each having an upper surface 76 spaced a predetermined distance "A" from the underside 78 of the head section 62. The upper surface 76 of the feet 74 and the underside 78 of the head section 62 are substantially flat and parallel to one another. The total length "L" of both feet 74 measured between the distal ends 80 of the feet 74 is approximately equal to the cross-wise dimension, or diameter, "D" of the head section 62. In addition, the width "W" of each foot 74 is relatively narrow and significantly less than the dimension "D" of the head section 62 and length "L" of the feet 74.

The fastener 60 is injection molded of one-piece integral hard durable plastic. As an example, a hard durable plastic such as DELRIN 107 manufactured by E.I. Dupont De Nemours and Company Corporation can be utilized. Alternatively, other plastic materials as well as other materials such as metal, steel and the like may be used to form the fastener 60 provided they have the requisite elastic properties.

According to the present invention, the goal frame 82 includes an elongate channel 84, such as a C-shaped channel. For example, the channel is formed by an elongate recess extending longitudinally in all sections of the frame 82 to which the peripheral edge 86 of the net is to be attached to the frame 82. The channels 84 extend continually along the length thereof and may or may not have interruptions. In the embodiment illustrated in FIG. 10, the channel 84 includes an inner wall 88, a pair of longitudinally-extending sidewalls 90, and a pair of inturned flanges 92 extending from each sidewall 90. The inturned flanges 92 define the width "B" of the opening 94 of the channel 84. Channels according to other contemplated embodiments may not include sidewalls and/or an inner wall.

When the feet 74 of the fastener 60 are oriented parallel to the channel opening 94, the body section 62 of the fastener can be inserted into the channel 84. The edge, perimeter rope, tie rope, or the like 86 of the net can be positioned within the slot 72 between the legs 70 of the fastener for insertion into the channel 84 with the fastener 60. Alternatively, the edge, perimeter rope, tie rope, or the like 86 of the net can be positioned within the channel 84 before the fastener 60 is inserted into the channel 84. Thereafter, the fastener 60 is rotated about 90° to position the inturned flanges 92 between the feet 74 and head section 62 of the fastener 60 in a so-called locking position (see FIG. 10). Rotation of the fastener 60 to the locking position is preferably accomplished with the use of a hex wrench, tool, key or the like (not shown).

When the fastener 60 is in the locking position, each inturned flange 92 is wedged between and frictionally engaged by the underside 78 of the head section 62 and the upper surface 76 of one of the feet 74 of the fastener 60. In this position, it is extremely difficult for the head section 62 to be gripped by hand and turned. Thus, unwanted removal or theft of the net is prevented.

Figure 10:
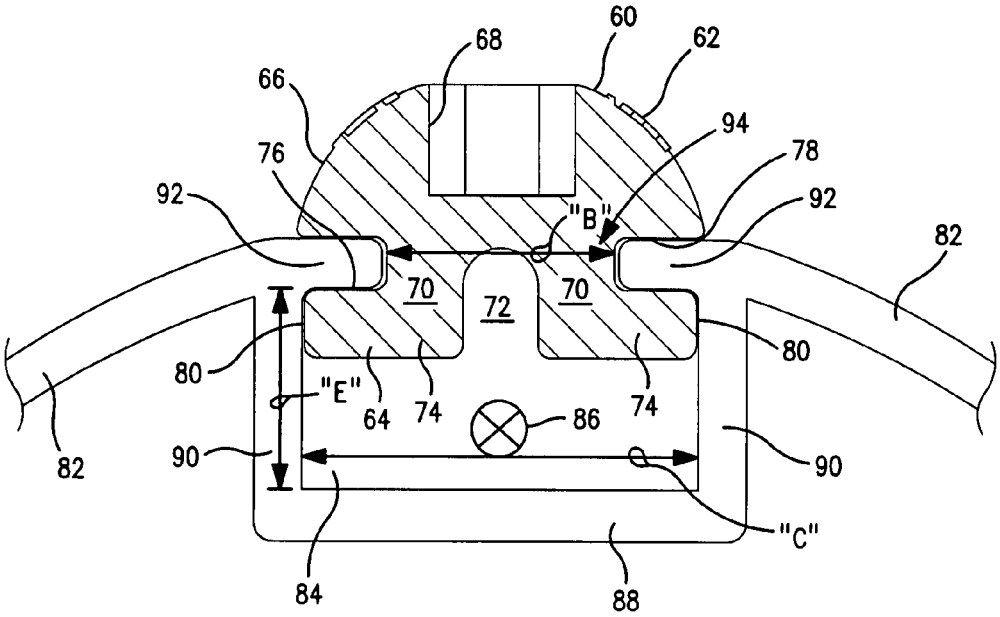
FIG. 10 is a cross-sectional view of a section of a goal frame in which the clip, or fastener, according to the present invention is secured.

Preferably, the distal ends 80 of the feet 74 simultaneously engage the opposite sidewalls 90 of the channel 84. Thus, as best illustrated in FIG. 10, the inturned flanges 92 are wedged between the head section 62 and feet 74 of the fastener 60 and the feet 74 of the fastener 60 are wedged between the sidewalls 90 of the channel 84 to ensure that the fastener 60 is locked to the goal frame. Preferably, the length "L" of the feet 74 is slightly greater than the width "C" of the channel, and the legs 70 of the fastener 60 are substantially resilient. Thus, when the fastener 60 is rotated into the locking position, legs 70 are forced to deflect toward one another by the sidewalls 80 of the channel 84 into in a substantially spring-loaded position. This further ensures a tight connection. In addition, the resilient flexure of the legs and sidewalls causes an audible snap-action sound to be produced, thereby providing a "locked" indicator.

As best illustrated in FIG. 10, the perimeter rope 86 of the net is captured within the channel 84 below the level of the channel opening 94 by the fastener 60 when the fastener 60 is locked to the channel 84. The depth "E" of the channel 84 is greater than the thickness of the feet 74 of the fastener 60. Thus, the feet 74 of the fastener 60 do not extend to the inner wall 88 of the channel 84 thereby providing a relatively large space defined by the bottom of the fastener 60 and the sidewalls 90 and inner wall 88 of the channel 84 within which the perimeter rope 86 of the net is housed. This ensures that the channel 84 provides ample space for the perimeter rope 86 regardless of the size, or diameter, of the rope 86. In addition, since the perimeter rope 86 is located entirely within the channel 84, it is protected from the elements thereby lengthening its useable life.

When removal of the net from the goal frame is desired, a special tool, such as a hex wrench or like key, is inserted into depression 68 of the head section 62 to rotate the fastener about 90° from the locking position. The fastener 60 and net 86 can then be removed from the channel 84 since the width "W" of the feet 74 is less than the width "B" of the opening 94 of the channel 84.

The method of securing a net to a goal frame according to the present invention is as follows. A section of a perimeter rope of a net 86 is placed in slot 72 of the fastener 60. If the net does not include a perimeter rope, the edges of the net itself may be inserted in the slot. A hex tool or the like is inserted into depression 68 on the head section 62 of the fastener 60, and the feet 74 of the fastener 60 are aligned parallel to the opening 94 of the channel 84 of the goal frame 82. The fastener 60 and perimeter rope of the net 86 are inserted, preferably simultaneously, into the channel 84, and the tool is used to rotate the fastener 60 about 90° into a locking position in which the inturned flanges 92 of the channel 84 are frictionally engaged by the head section 62 and feet 74 of the fastener 60. The frictional engagement is sufficiently strong to secure the fastener 60 to the goal frame 82 and to prevent manual rotation of the fastener 60 without the tool.

Preferably, as discussed above, the feet 74 of the fastener 60 are clamped or wedged between the sidewalls 90 of the channel 84. This frictional engagement is also sufficiently strong to secure the fastener 60 to the goal frame 82 and to prevent manual rotation of the fastener 60 without the tool. The distal ends 80 of the feet 74 can be rounded or chamfered to enable the feet to be more readily brought to a crosswise position in the channel. The legs 70 of the fastener 60 have a some elasticity which allows the feet 74 to engage the sidewalls 90 of the channel 84 in a spring-loaded condition.

A sufficient number of fasteners 60 are secured to the goal frame at spaced intervals of about eight to sixteen inches so that the net is securely connected to the goal frame with no gaps between the goal frame and net to allow a soccer ball or the like to pass therethrough. When removal is desired, the tool is utilized to rotate and remove the fasteners and net from the channels. The fasteners 60 can be adapted to be turned by any suitable hand tool that is not typically carried by an ordinary passerby, such as a common or Phillips head screwdriver, Allen wrench, or the like.

While preferred fasteners, assemblies, and methods have been described in detail, various modifications, alterations, and changes may be made without departing from the spirit and scope of the fasteners, assemblies, and methods according to the present invention as defined in the appended claims.

This invention claimed is:

1. A sports goal assembly, comprising:

a goal net having a peripheral edge;

a goal frame defining a goal mouth and having an elongate channel in which said peripheral edge of said goal net is removably securable to said goal frame, said channel having a pair of inturned flanges defining an elongate opening; and a tamper resistant net fastener having a head section and a body section depending from said head section;

said body section being insertable into said channel and positionable into a locking position within said channel in which the fastener frictionally engages said inturned flanges of said channel to capture said peripheral edge of said net within said channel; and said head section having an upper surface formed to be difficult to grasp and turn by hand when said fastener is frictionally engaged with said channel, said head section also having a tool engaging surface engagable by a separate tool for use in rotating said fastener from said locking position to an unlocking position permitting removal of said fastener and said net from said channel;

whereby removal of said net from said goal frame requires use of a separate tool, thereby deterring unwanted removal of said net and fasteners from said goal frame.

2. A sports goal assembly according to claim 1, wherein said tool engaging surface of said head section includes a shaped depression mechanically engagable by a tip of a like-shaped tool.

3. A sports goal assembly according to claim 2, wherein said depression is hex-shaped for mechanical engagement by a hex wrench.

4. A sports goal assembly according to claim 2, wherein said head section of said fastener is substantially dome-shaped.

5. A sports goal assembly according to claim 4, wherein said inturned flanges of said channel are of a predetermined thickness, and wherein said body section of said fastener includes a spaced-apart pair of legs having oppositely and outwardly extending foot members, each foot member extending a predetermined spaced distance underneath an underside of said head section, said predetermined spaced distance corresponds to said predetermined thickness of said inturned flanges of said channel.

6. A sports goal assembly according to claim 5, wherein, when said fastener is inserted within said channel and positioned in said locking position, said inturned flanges of said channel are captured between, and frictionally engaged by, said foot members and said underside of said head section of said fastener to secure said net to said goal frame.

7. A sports goal assembly according to claim 6, wherein said channel includes a pair of spaced-apart longitudinally-extending sidewalls, and wherein, when said fastener is inserted within said channel and positioned in said locking position, said foot members are captured between, and are frictionally engaged by, said sidewalls of said channel to secure said net to said goal frame.

8. A sports goal assembly according to claim 7, wherein said legs of said fastener are resilient and the spacing between said pair of legs enables said legs to deflect resiliently toward one another when said fastener is in said locking position within said channel.

9. A sports goal assembly according to claim 8, wherein said channel includes an inner wall opposite said channel opening, and wherein, when said fastener is inserted within said channel and positioned in said locking position, said foot members are located a spaced distance from said inner wall.

10. A sports goal assembly according to claim 9, wherein said fastener is an integral injection molded piece of hard durable plastic.

11. A method of assembling a net to a sports goal frame, comprising the steps of:

providing a goal net having a peripheral edge and a goal frame defining a goal mouth and having an elongate opening defined by a pair of inturned flanges;

providing a tamper resistant net fastener having a head section and a body section depending from the head section;

inserting the peripheral edge of the goal net and the body section of the fastener through the elongate opening such that the peripheral edge of the goal net is captured to the goal frame by the fastener; and mechanically engaging the head section of the fastener with a separate tool and rotating the fastener into a locking position in which the fastener frictionally engages the inturned flanges to secure the fastener to the goal frame;

the head section of the fastener having a non-grippable upper surface which is difficult to grasp and turn by hand when the fastener is frictionally engaged to the channel;

whereby removal of the goal net from the goal frame requires use of the separate tool, thereby deterring unwanted removal of the goal net and fasteners from the goal frame.

12. A method according to claim 11, further comprising the steps of mechanically engaging the head section of the fastener with the separate tool when the fastener is in the locking position and rotating the fastener from the locking position to an unlocking position permitting removal of the fastener and the goal net from the goal frame.

* * * * *